US007298354B2

(12) United States Patent
Yang

(10) Patent No.: US 7,298,354 B2
(45) Date of Patent: Nov. 20, 2007

(54) LIQUID CRYSTAL DISPLAY WITH IMPROVED MOTION IMAGE QUALITY AND A DRIVING METHOD THEREFOR

(75) Inventor: Chien-Sheng Yang, Jhudong Township, Hsinchu County (TW)

(73) Assignee: AU Optronics Corp., Hsinchu (TW)

( * ) Notice: Subject to any disclaimer, the term of this patent is extended or adjusted under 35 U.S.C. 154(b) by 583 days.

(21) Appl. No.: 11/005,006

(22) Filed: Dec. 7, 2004

(65) Prior Publication Data

US 2005/0253826 A1 Nov. 17, 2005

(30) Foreign Application Priority Data

May 12, 2004 (TW) ..... 93113376 A

(51) Int. Cl.
*G09G 3/36* (2006.01)

(52) U.S. Cl. ..... 345/90; 345/92

(58) Field of Classification Search ..... 345/87–100, 345/204, 690–697; 315/169.1, 169.3; 349/43
See application file for complete search history.

(56) References Cited

U.S. PATENT DOCUMENTS 7,122,969 B2 * 10/2006 Fukumoto et al. ..... 315/169.3
2002/0089615 A1 * 7/2002 Sakamoto et al. ..... 349/43
2003/0058231 A1 * 3/2003 Kitaura et al. ..... 345/204
2003/0160747 A1 * 8/2003 Morita ..... 345/87
2004/0119677 A1 * 6/2004 Nakamura et al. ..... 345/89
2004/0145581 A1 * 7/2004 Morita ..... 345/204
2005/0052382 A1 * 3/2005 Lin et al. ..... 345/87
2005/0225523 A1 * 10/2005 Park ..... 345/87

* cited by examiner

*Primary Examiner*—Nitin I. Patel
(74) *Attorney, Agent, or Firm*—Rabin & Berdo, P.C.

(57) ABSTRACT

A liquid crystal display (LCD) with improved motion image quality. The LCD displays a frame during a frame time. A pixel of the LCD has a first switch and a second switch. At a first time point, the first switch is turned on by a video scan line, and a video data signal is transmitted to the pixel through a video data line, which make the pixel have first luminance intensity. At a second time point, the second switch is turned on by a particular color signal scan line, and a particular color data signal is transmitted to the pixel through a particular color signal data line, which make the pixel have second luminance intensity smaller than the first luminance intensity. A time interval between the second time point and the first time point is smaller than the frame time and the image dragging phenomenon is avoided.

21 Claims, 6 Drawing Sheets

LIQUID CRYSTAL DISPLAY WITH IMPROVED MOTION IMAGE QUALITY AND A DRIVING METHOD THEREFOR

This application claims the benefit of Taiwan application Serial No. 93113376, filed May 12, 2004, the subject matter of which is incorporated herein by reference.

BACKGROUND OF THE INVENTION

1. Field of the Invention

The invention relates in general to a liquid crystal display (LCD) and a driving method therefor, and more particularly to a LCD with improved motion image quality and a driving method therefor.

2. Description of the Related Art

FIG. 1 is a partially schematic illustration showing a conventional amorphous silicon thin film transistor LCD. Referring to FIG. 1, the LCD has a plurality of pixels P arranged in an array, a plurality of scan lines S and a plurality of data lines D orthogonal to the scan lines. Each pixel P has a thin film transistor (TFT) M, a liquid crystal capacitor Clc and a storage capacitor Cst. The liquid crystal capacitor Clc is an equivalent component of a common electrode (not shown) on a top substrate, a pixel electrode (not shown) on a bottom substrate and a liquid crystal layer (not shown) encapsulated between the top substrate and the bottom substrate. The thin film transistor M has a gate coupled to a corresponding scan line, a drain coupled to a corresponding data line, and a source coupled to a corresponding pixel electrode.

The operation state of the LCD will be described by taking the scan lines S(I) and S(I+1), data lines D(J) and D(J+1), and pixels P(I, J) to P(I+1, J+1) as an example. The conventional LCD belongs to a hold type image display mode. When the scan lines S(I) and S(I+1) are sequentially turned on, the voltages corresponding to the pixel data of the pixels P(I, J) to P(I+1, J+1) are respectively inputted to the pixels P(I, J) to P(I+1, J+1) from the data lines D(J) and D(J+1), and these voltages are respectively held by the storage capacitor Cst of each pixel such that the voltage difference between two ends of each liquid crystal capacitor Clc is almost kept at the original voltage for a frame time FT. Therefore, the pixels P(I, J) to P(I+1, J+1) emit light for a frame time FT in order to display the desired frame. The relationship curve between the luminance intensity of a certain pixel and the time while the conventional LCD is displaying an image is shown in FIG. 2.

However, because the conventional LCD belongs to the hold type image display mode, the image dragging phenomenon tends to be caused and the motion image quality is deteriorated when the LCD is displaying the motion images (motion pictures) rapidly. Consequently, it is an important subject in this field to avoid the image dragging phenomenon of the LCD and enhance the motion image quality.

SUMMARY OF THE INVENTION

It is therefore an object of the invention to provide a LCD with improved motion image quality and a driving method therefor capable of improving the image dragging phenomenon of the LCD and enhancing the motion image quality.

The invention achieves the above-identified object by providing a liquid crystal display (LCD) with improved motion image quality. The LCD displays a frame during a frame time and comprises a pixel, a video scan line, a video data line, a particular color signal scan line and a particular color signal data line. The pixel has a first switch and a second switch. The video scan line is for controlling the first switch. The video data line is coupled to the first switch. At a first time point, the first switch is turned on, and a video data signal is transmitted to the pixel through the video data line such that the pixel has first luminance intensity. The particular color signal scan line is for controlling the second switch. The particular color signal data line is coupled to the second switch. At a second time point, the second switch is turned on, and a particular color data signal is transmitted to the pixel through the particular color signal data line such that the pixel has second luminance intensity smaller than the first luminance intensity. A time interval between the second time point and the first time point is smaller than the frame time.

The invention also achieves the above-identified object by providing a liquid crystal display (LCD) with improved motion image quality. The LCD displays a frame during a frame time and comprises M*N pixels, M video scan lines, N video data lines, M particular color signal scan lines, N particular color signal data lines, a video scan driver, a video data driver and a particular color data driver.

The M*N pixels are arranged in M rows and N columns, and one of the M*N pixels is defined as a pixel (I, J), wherein I is a positive integer smaller than or equal to M, J is a positive integer smaller than or equal to N, and the pixel (I, J) includes a first switch (I, J) and a second switch (I, J). One of the M video scan lines is defined as a video scan line (I), which is for controlling the first switch (I, J). One of the N video data lines is a video data line (J), which is coupled to the first switch (I, J). At a first time point, the first switch (I, J) is turned on and a video data signal (I, J) is transmitted to the pixel (I, J) through the video data line (J) such that the pixel (I, J) has first luminance intensity (I, J). The M particular color signal scan lines respectively receive M particular color scan signals. One of the M particular color signal scan lines is defined as a particular color signal scan line (I), and one of the M particular color scan signals is defined as a particular color scan signal (I). The second switch (I, J) is turned on when the particular color scan signal (I) is enabled. One of the N particular color signal data lines is defined as a particular color signal data line (J), which is coupled to the second switch (I, J). At a second time point, the second switch (I, J) is turned on and a particular color data signal (I, J) is transmitted to the pixel (I, J) through the particular color signal data line (J) such that the pixel (I, J) has a second luminance intensity (I, J), which is smaller than the first luminance intensity (I, J). A time interval between the second time point and the first time point is smaller than the frame time. The video scan driver drives the M video scan lines. The video data driver drives the N video data lines. The particular color data driver drives the N particular color signal data lines.

In addition, the LCD of the invention further comprises a particular color signal scan driver for outputting the M particular color scan signals to drive the M particular color signal scan lines. Alternatively, in the LCD of the invention, another one of the M particular color signal scan lines is defined as a particular color signal scan line (K), wherein K is a positive integer smaller than or equal to M but not equal to I, and the particular color signal scan line (I) is electrically connected to the particular color signal scan line (K).

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
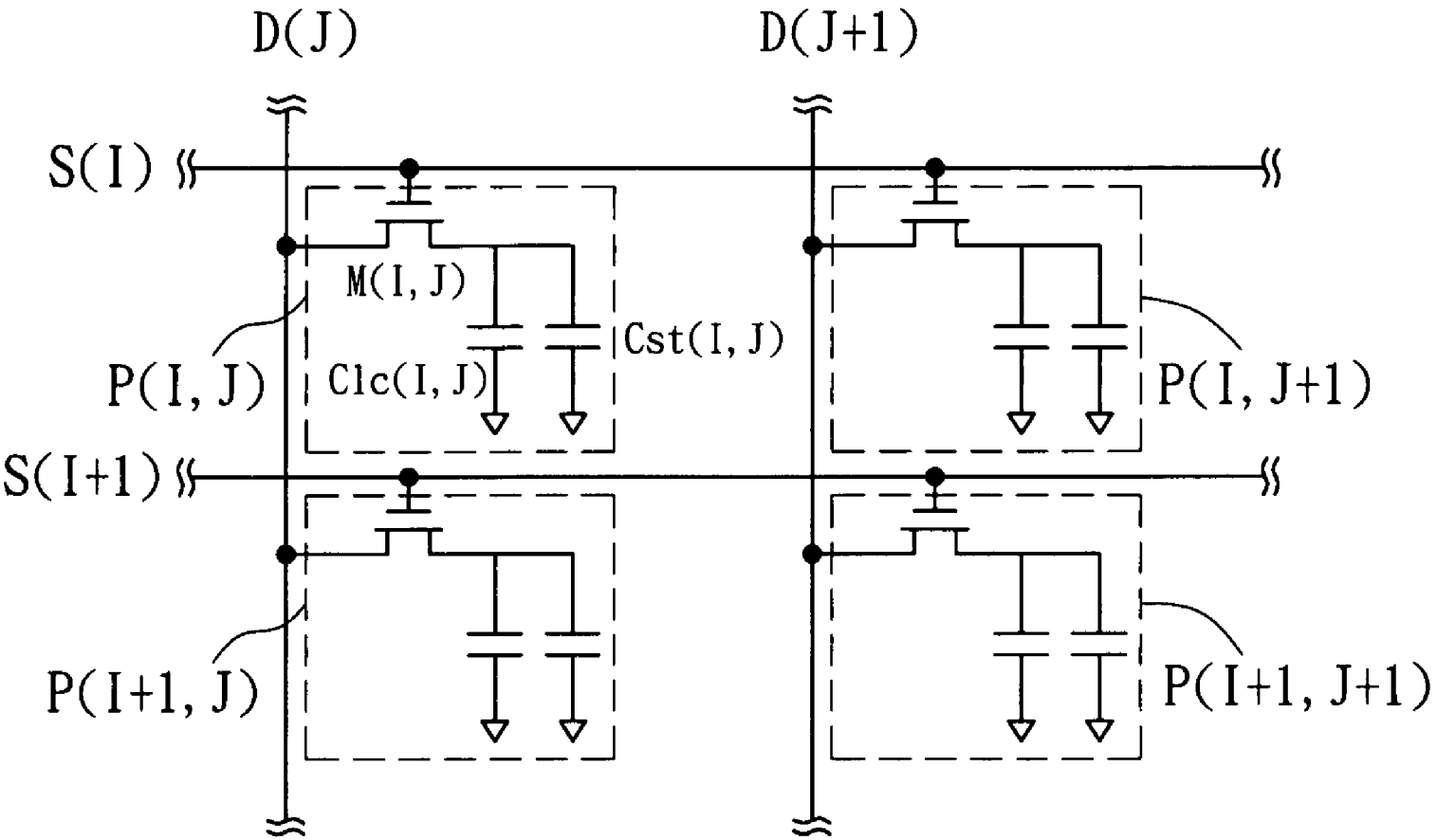
FIG. 1(PRIOR ART)
FIG. 1 is a partially schematic illustration showing a conventional amorphous silicon thin film transistor LCD.
Figure 2:
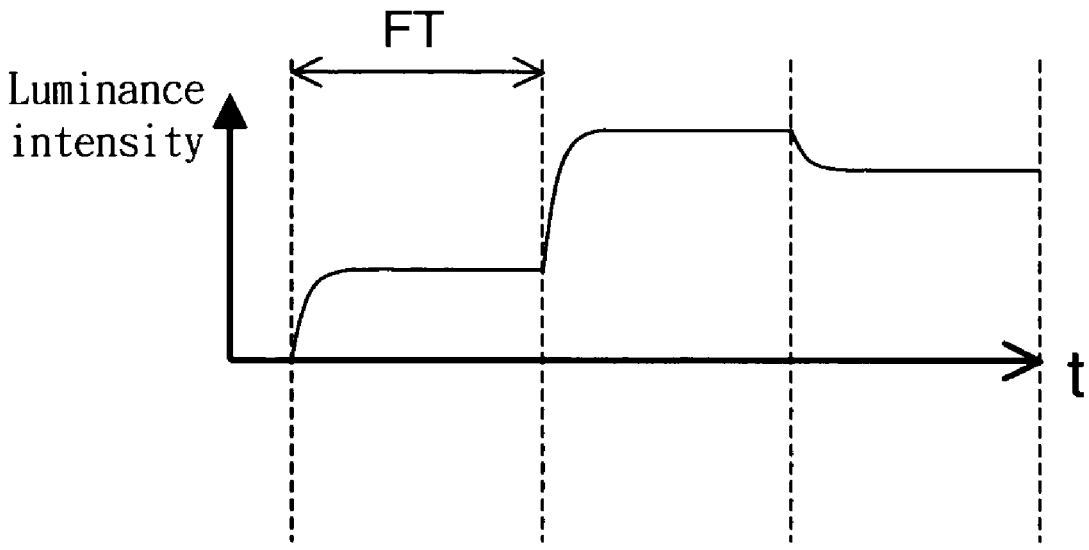
FIG. 2(PRIOR ART)
FIG. 2 is a curve showing a relationship between the luminance intensity of a certain pixel and the time when the conventional LCD is displaying an image.
Figure 3:
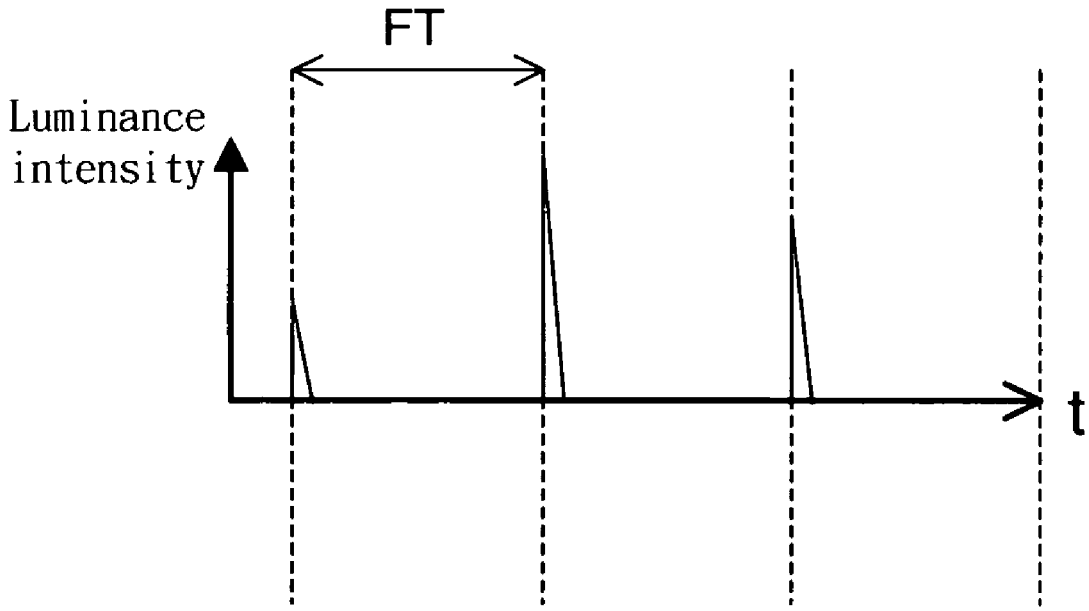
FIG. 3(PRIOR ART)
FIG. 3 shows the relationship between the luminance intensity of a certain pixel and the time when a CRT monitor is displaying an image.

FIG. 3 shows the relationship between the luminance intensity of a certain pixel and the time when a CRT monitor is displaying an image. As shown in FIG. 3, because the conventional CRT monitor belongs to the impulse type image display mode, electron beams impact upon the fluorescent layer within a frame time FT of one frame such that a certain pixel of the CRT monitor outputs strong light in a very short period of time. Thereafter, the pixel of the CRT monitor quickly returns to the dark state such that the conventional CRT monitor has no image dragging phenomenon. So, the invention has an additional switch in the pixel to turn the pixel into the dark state at the proper time point so as to simulate the impulse type image display mode of the CRT monitor and thus to suppress the image dragging phenomenon of the LCD.

FIRST EMBODIMENT

Figure 4:
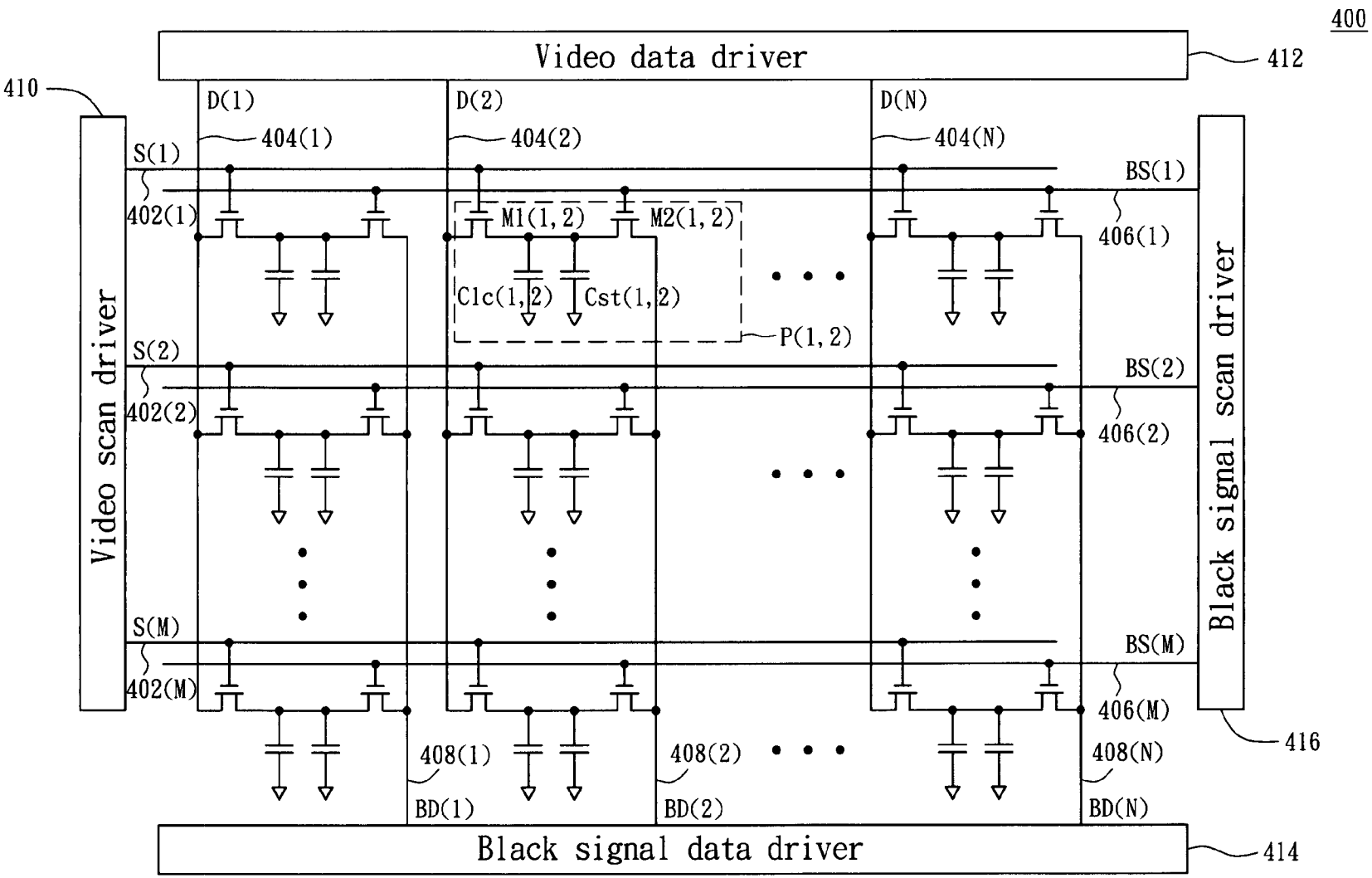
FIG. 4 is a schematic illustration showing a LCD with improved motion image quality according to a first embodiment of the invention.

FIG. 4 is a schematic illustration showing a display with improved motion image quality according to a first embodiment of the invention. Referring to FIG. 4, the display 400 of the invention, such as a LCD, displays a frame during a frame time FT. The display 400 comprises M*N pixels P, M video scan lines 402(1) to 402(M), N video data lines 404(1) to 404(N), M black signal scan lines 406(1) to 406(M), N black signal data lines 408(1) to 408(N), a video data driver 412, a video scan driver 410, a black signal data driver 414 and a black signal scan driver 416.

Figure 5:
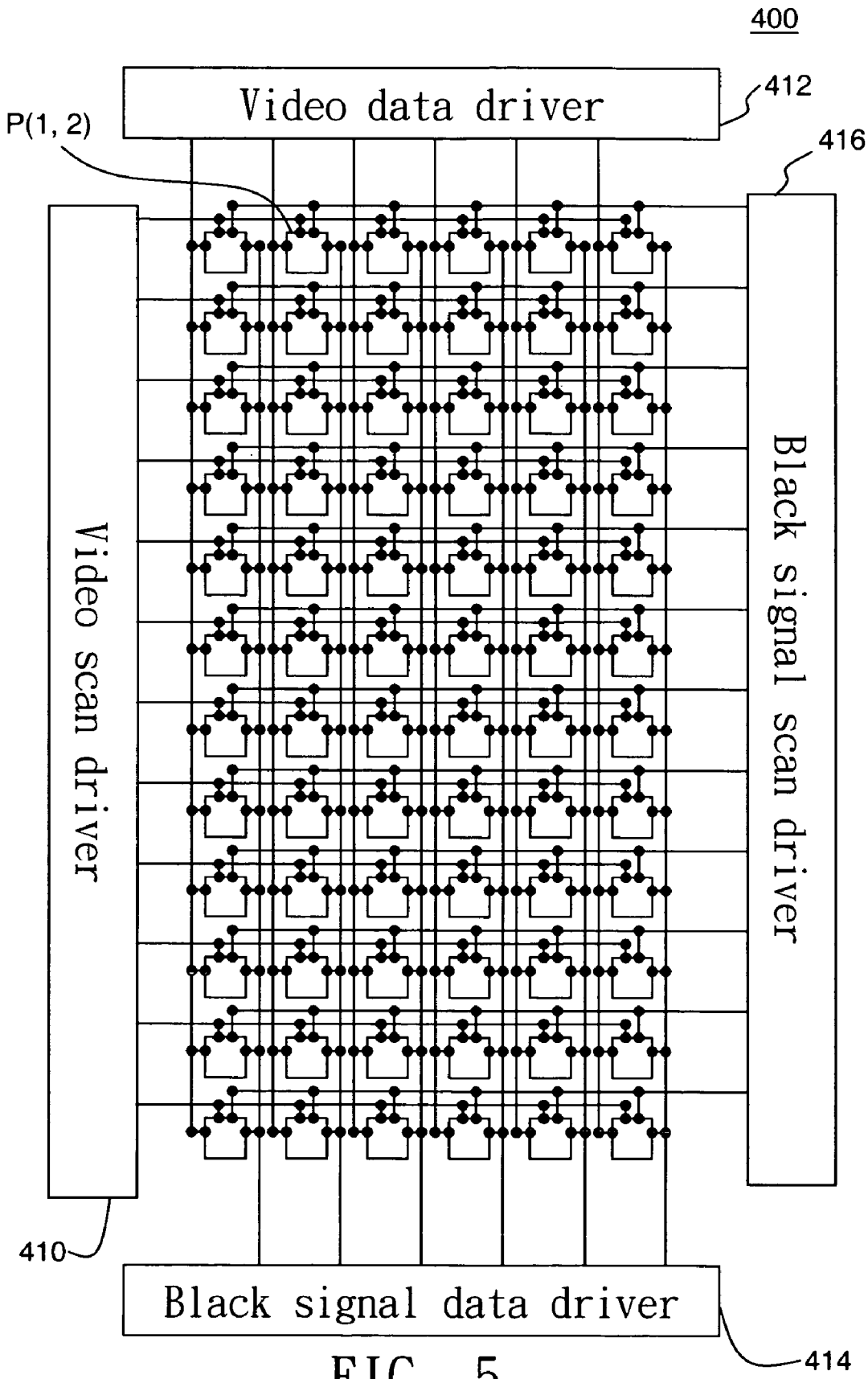
FIG. 5 is an architecture diagram showing the LCD of FIG. 4 when M equals 12 and N equals 6.

For the sake of clear illustration, please refer to FIG. 5. FIG. 5 is an architecture diagram showing the LCD of FIG. 4 when M equals 12 and N equals 6. M*N pixels are arranged in M rows by N columns. The pixel at the I-th row and J-th column is defined as pixel (I, J), wherein I is a positive integer smaller than or equal to M, J is a positive integer smaller than or equal to N. The pixel (I, J) has a pixel electrode (I, J), a first switch (I, J) and a second switch (I, J). The first switch (I, J) is, for example, a first thin film transistor M1(I, J). The second switch (I, J) is, for example, a second thin film transistor M2(I, J). M video scan lines 402(1) to 402(M) are respectively coupled to gates of the first thin film transistors M1 of the 1st to M-th rows. N video data lines 404(1) to 404(N) are respectively coupled to drains of the first thin film transistors M1 of the 1st to N-th columns. The source of each first thin film transistor M1 is coupled to the corresponding pixel electrode. M black signal scan lines 406(1) to 406(M) are respectively coupled to gates of the second thin film transistors M2 of the 1st to M-th rows. N black signal data lines 408(1) to 408(N) are respectively coupled to drains of the second thin film transistors M2 of the 1st to N-th columns. The source of each second thin film transistor M2 is coupled to the corresponding pixel electrode.

The video scan driver 410 outputs video scan signals S(1) to S(M) to drive the M video scan lines 402(1) to 402(M). The video data driver 412 outputs video data signals D(1) to D(N) to drive the N video data lines 404(1) to 404(N). The black signal scan driver 416 outputs M black scan signals BS(1) to BS(M) to drive the M black signal scan lines 406(1) to 406(M). The black signal data driver 414 outputs black data signals BD(1) to BD(N) to drive the N black signal data lines 408(1) to 408(N).

An example of the pixel P(1,2) at the corresponding first row and second column, in which I equals 1 and J equals 2, will be described. The pixel P(1,2) includes a first thin film transistor M1(1,2), a second thin film transistor M2(1,2) and a storage capacitor Cst(1,2). The pixel P(1,2) further includes a common electrode (not shown) on a top substrate, a pixel electrode (not shown) on a bottom substrate, and a liquid crystal layer (not shown) encapsulated between the top substrate and the bottom substrate, wherein all of the electrodes are equivalent to a liquid crystal capacitor Clc(1, 2).

The first thin film transistor M1(1,2) has a gate coupled to the video scan line 402(1), a drain coupled to the video data line 404(2), and a source coupled to the liquid crystal capacitor Clc(1,2) and the storage capacitor Cst(1,2). The second thin film transistor M2(1,2) has a gate coupled to the black signal scan line 406(1), a drain coupled to the black signal data line 408(2), and a source coupled to the liquid crystal capacitor Clc(1,2) and the storage capacitor Cst(1,2).

Figure 6:
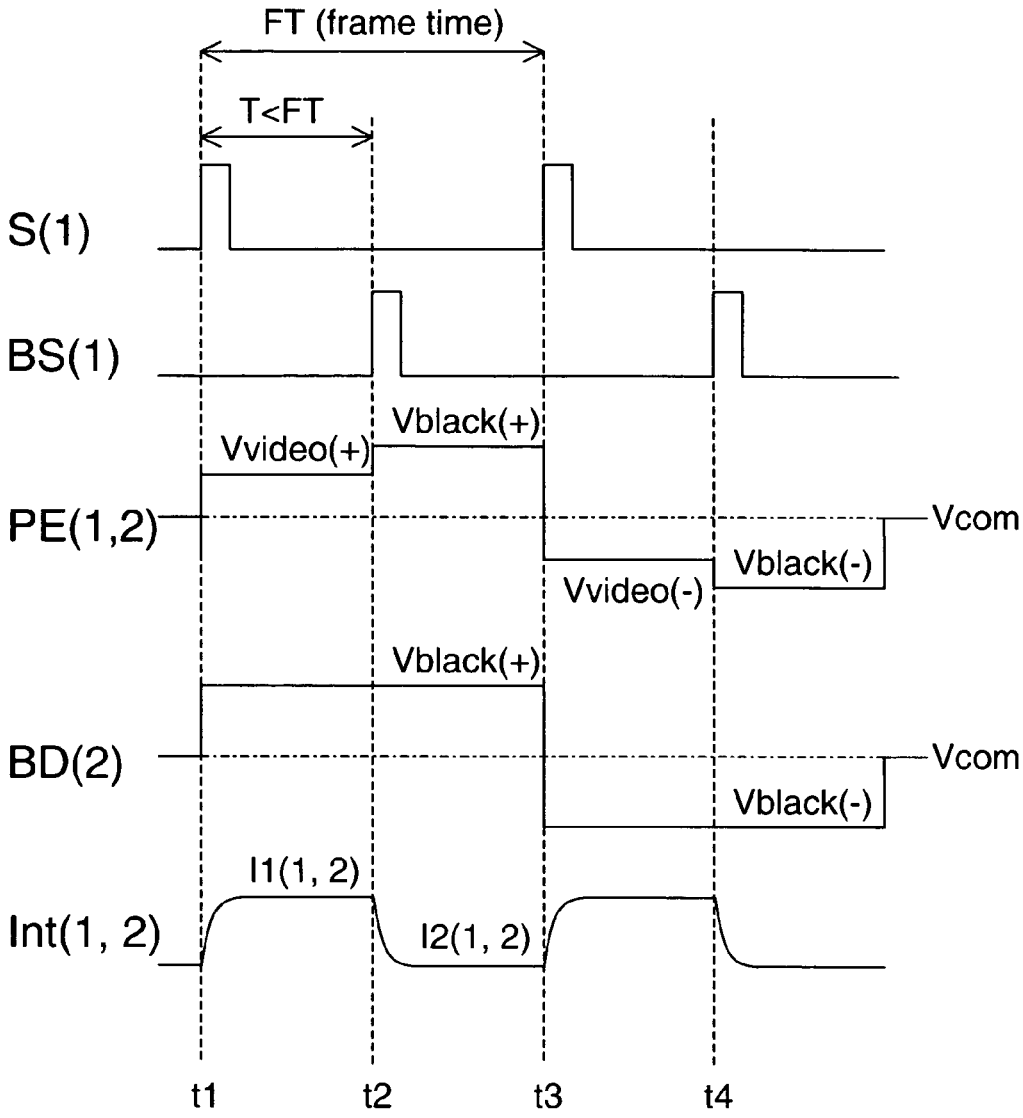
FIG. 6 is a driving waveform diagram showing the LCD of FIG. 4 according to the first embodiment of the invention.

FIG. 6 is a driving waveform diagram showing the display of FIG. 4 according to the first embodiment of the invention. As shown in FIGS. 6 and 4, the column inversion driving method will be used in the display 400 as an example. At a first time point t1, the video scan signal S(1) is enabled such that the first thin film transistor M1(1,2) is turned on. At this time, the video data signal D(2) is transmitted to the pixel P(1,2) through the video data line 404(2) such that the voltage level of the pixel electrode PE(1,2) of the pixel P(1,2) is the video voltage Vvideo. At this time, the luminance intensity Int(1,2) of the pixel P(1,2) is first luminance intensity I1(1,2). At a second time point t2, the black scan signal BS(1) is enabled such that the second thin film transistor M2(1,2) is turned on. At this time, the black data signal BD(2) is transmitted to the pixel P(1,2) through the black signal data line 408(2) such that the voltage level of the pixel electrode PE(1,2) of the pixel P(1,2) is the black voltage Vblack. At this time, the luminance intensity Int(1,2) of the pixel P(1,2) is a second luminance intensity I2(1,2), which is smaller than the first luminance intensity I1(1,2). A time interval T between the second time point t2 and the first time point t1 is smaller than a frame time FT.

If the frames displayed from the first time point t1 to the third time point t3 belong to the positive polarity drive, the video data signal D(2) received by the pixel P(1,2) is the positive polarity video voltage Vvideo(+), and the black data signal BD(2) received by the pixel P(1,2) is the positive polarity black voltage Vblack(+). If the next frame to be displayed after the third time point t3 belongs to the negative polarity drive, the video data signal D(2) received by the pixel P(1,2) is the negative polarity video voltage Vvideo(−) when the next frame is displayed, and the pixel P(1,2) receives the black data signal BD(2) of the negative polarity black voltage Vblack(−) at a fourth time point t4 when the black data signal BD(2) is enabled. The levels and waveforms of the black data signals BD(1) to BD(N) are adjusted according to the type and driving method of the display 400 such that the corresponding pixel is black. The positive polarity voltage is higher than the common voltage Vcom of the common electrode, and the negative polarity voltage is smaller than the common voltage Vcom.

The time interval T between the second time point t2 and the first time point t1 may be adjusted according to the property of the display 400 such that the image dragging phenomenon may be sufficiently improved when the display 400 is displaying the motion images. In this embodiment, for example, the time interval T is substantially equal to one half of the frame time FT.

Although the embodiment is illustrated by making the pixel P(1,2) black after the second time point t2, it is considered within the scope of the invention as long as the pixel P(1,2) of the LCD of other particular colors is in the dark state or substantially dark state after the second time point t2. This embodiment is to light the pixel P for a time interval T and then to turn the pixel into the dark state, such that the image display mode of the display 400 is similar to the impulse type image display mode. Consequently, the image dragging phenomenon of the display 400 can be improved.

SECOND EMBODIMENT

What is different from the first embodiment is that black signal scan lines corresponding to a certain rows of pixels are electrically connected to the video scan lines corresponding to other rows of pixels in the display of the second embodiment, wherein the video scan signals for the other rows of pixels serves as the black scan signals for the certain rows of pixels. This embodiment has the advantage of eliminating the black signal scan driver.

Figure 7:
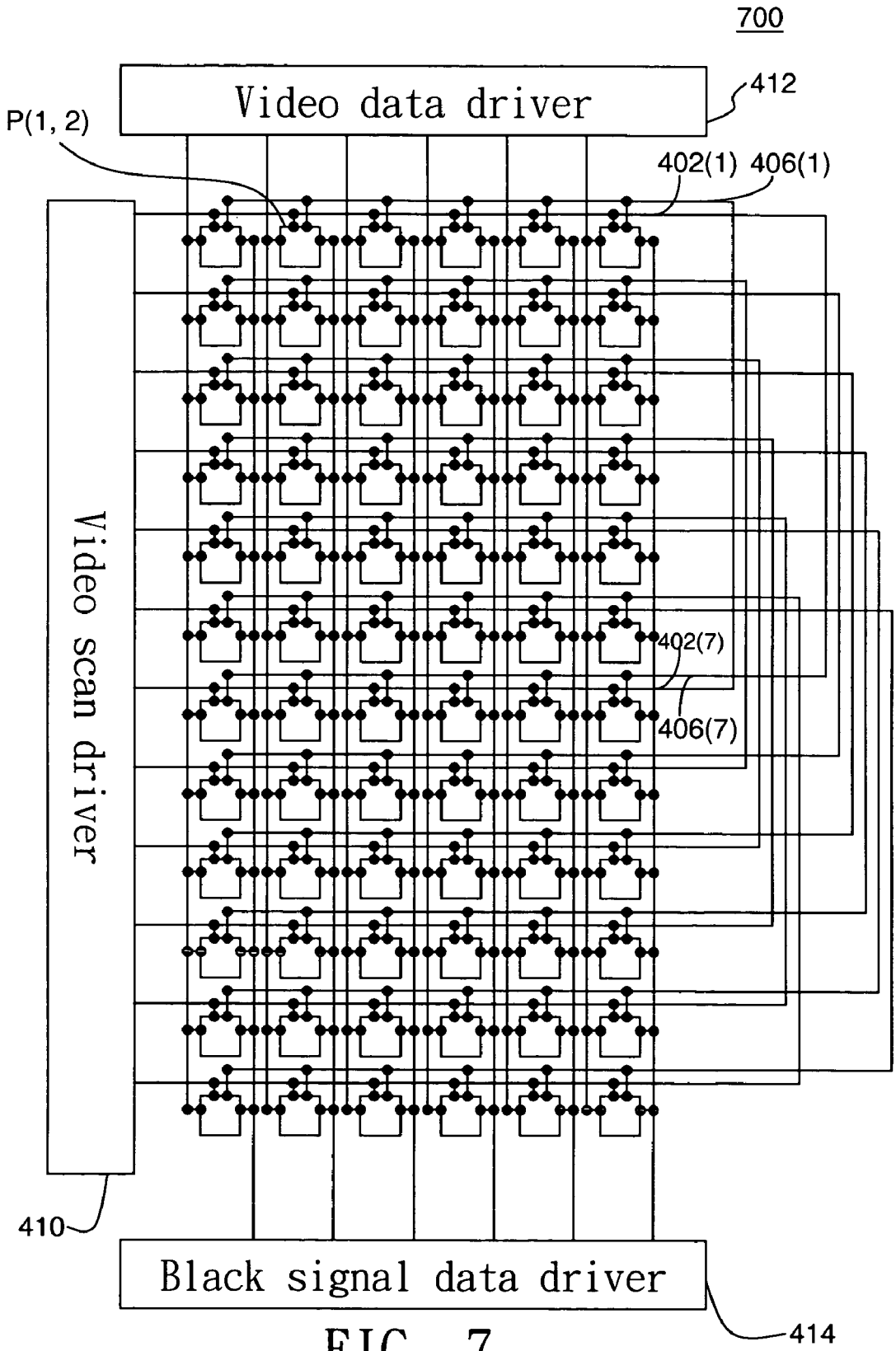
FIG. 7 is an architecture diagram showing a LCD with improved motion image quality according to a second embodiment of the invention.

FIG. 7 is an architecture diagram showing a display 700, such as a LCD, with improved motion image quality according to a second embodiment of the invention. The LCD 700, in which M equals 12, N equals 6, and the time interval T between the first time point t1 and the second time point t2 equals one half of the frame time FT, is illustrated in FIG. 7. In FIG. 7, the same symbols denote the same components as those of FIG. 4. Illustration will be make by taking the black signal scan line 406(I) corresponding to the I-th row of pixels as an example. Because the time interval T equals one half of the frame time FT, the black signal scan line 406(I) is electrically connected to the video scan line 402(I+M/2), such that the video scan signal S(I+M/2) transmitted through the video scan line 402(I+M/2) is also transmitted to the black signal scan line 406(1) as the black scan signal BS(I). In addition, the black signal scan line 406(I+M/2) is electrically connected to the video scan line 402(I), such that the video scan signal S(I) transmitted through the video scan line 402(I) is also transmitted to the black signal scan line 406(I+M/2) as the black scan signal BS(I+M/2).

For example, when M equals 12, the black signal scan line 406(1) is electrically connected to the video scan line 402(7), such that the video scan signal S(7) transmitted through the video scan line 402(7) is also transmitted to the black signal scan line 406(1) as the black scan signal BS(1). In addition, the black signal scan line 406(7) is electrically connected to the video scan line 402(1), such that the video scan signal S(1) transmitted through the video scan line 402(1) is also transmitted to the black signal scan line 406(7) as the black scan signal BS(7). The connections between other black signal scan lines and other video scan lines are also similar to that as mentioned above, and detailed descriptions thereof will be omitted.

If the time interval T between the first time point t1 and the second time point t2 is adjusted to be another value, the connections between the black signal scan lines and other video scan lines have to be correspondingly adjusted. For example, if the time interval T equals one third of the frame time FT, the black signal scan line 406(I) is electrically connected to the video scan line 402(I+M/3) in order to achieve the object of reducing the number of black signal scan drivers in this embodiment.

The LCD with improved motion image quality and the driving method therefor according to the above-mentioned embodiments of the invention can improve the image dragging phenomenon of the LCD and enhance the motion image quality.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display for displaying a frame during a frame time, comprising:

a pixel including a first switch and a second switch;

a video scan line for controlling the first switch;

a video data line coupled to the first switch for transmitting a video data signal to the pixel at a first time point, thereby the pixel having a first luminance intensity;

a particular color signal scan line for controlling the second switch; and a particular color signal data line coupled to the second switch for transmitting a particular color data signal to the pixel at a second time point, thereby the pixel having a second luminance intensity.

2. The display according to claim 1, wherein the second luminance intensity is smaller than the first luminance intensity.

3. The display according to claim 2, wherein the time interval between the second time point and the first time point is shorter than the frame time.

4. The display according to claim 3, wherein the time interval between the second time point and the first time point is substantially one half of the frame time.

5. The display according to claim 1, wherein the particular color signal scan line is a black signal scan line, the particular color signal data line is a black signal data line, and the particular color data signal is a black data signal.

6. The display according to claim 1, wherein the pixel further includes a pixel electrode, the first switch is a first thin film transistor, the second switch is a second thin film transistor, the first thin film transistor has a gate coupled to the video scan line, a drain coupled to the video data line and a source coupled to the pixel electrode, and the second thin film transistor has a gate coupled to the particular color signal scan line, a drain coupled to the particular color signal data line and a source coupled to the pixel electrode.

7. A display for displaying a frame during a frame time, comprising:

a plurality of pixels arranged in M rows and N columns, one of the plurality of pixels being defined as a pixel (I, J), I being a positive integer smaller than or equal to M, J being a positive integer smaller than or equal to N, and the pixel (I, J) including a first switch (I, J) and a second switch (I, J);

M video scan lines, one of the M video scan lines being defined as a video scan line (I) for controlling the first switch (I, J);

N video data lines, one of the N video data lines being a video data line (J) coupled to the first switch (I, J) for transmitting a video data signal (I, J) to the pixel (I, J) at a first time point, thereby the pixel (I, J) having a first luminance intensity (I, J);

M particular color signal scan lines, one of the M particular color signal scan lines being defined as a particular color signal scan line (I) for controlling the second switch (I, J);

N particular color signal data lines, one of the N particular color signal data lines being defined as a particular color signal data line (J) coupled to the second switch (I, J) for transmitting a particular color data signal (I, J) to the pixel (I, J) at a second time point, thereby the pixel (I, J) having a second luminance intensity (I, J);

a video scan driver for driving the M video scan lines;

a video data driver for driving the N video data lines; and a particular color data driver for driving the N particular color signal data lines.

8. The display according to claim 7, wherein the second luminance intensity is smaller than the first luminance intensity.

9. The display according to claim 8, wherein the time interval between the second time point and the first time point is shorter than the frame time.

10. The display according to claim 9, wherein the time interval between the second time point and the first time point is substantially one half of the frame time.

11. The display according to claim 7, further comprising a particular color signal scan driver for outputting M particular color scan signals to drive the M particular color signal scan lines.

12. The display according to claim 11, wherein the particular color signal scan driver is a black signal scan driver.

13. The display according to claim 7, wherein another one of the M particular color signal scan lines is defined as a particular color signal scan line (K), K is a positive integer smaller than or equal to M but not equal to I, and the video scan line (I) is electrically connected to the particular color signal scan line (K).

14. The display according to claim 13, wherein the difference between K and I is equal to M/2.

15. The display according to claim 7, wherein the M particular color signal scan lines are M black signal scan lines, the N particular color signal data lines are N black signal data lines, the particular color data signal (I, J) is a black data signal, and the particular color data driver is a black signal data driver.

16. The display according to claim 7, wherein the pixel (I, J) further includes a pixel electrode (I, J), the first switch (I, J) is a first thin film transistor (I, J), the second switch (I, J) is a second thin film transistor (I, J), the first thin film transistor (I, J) has a gate coupled to the video scan line (I), a drain coupled to the video data line (J) and a source coupled to the pixel electrode (I, J), and the second thin film transistor (I, J) has a gate coupled to the particular color signal scan line (I), a drain coupled to the particular color signal data line (J) and a source coupled to the pixel electrode (I, J).

17. A method for driving a display, wherein the display displays a frame during a frame time and comprises a pixel including a first switch and a second switch, a video scan line, a video data line, a particular color signal scan line and a particular color signal data line, the driving method comprising:

turning on the first switch at a first time point;

transmitting a video data signal through the video data line to the pixel at the first time point, thereby the pixel having a first luminance intensity;

turning on the second switch at a second time point; and transmitting a particular color data signal through the particular color signal data line to the pixel at the second time point, thereby the pixel having a second luminance intensity.

18. The method according to claim 17, wherein the second luminance intensity is smaller than the first luminance intensity.

19. The method according to claim 18, wherein the time interval between the second time point and the first time point is shorter than the frame time.

20. The method according to claim 19, wherein the time interval between the second time point and the first time point is substantially one half of the frame time.

21. The method according to claim 17, wherein the particular color signal scan line is a black signal scan line, the particular color signal data line is a black signal data line, and the particular color data signal is a black data signal.

* * * * *